United States Patent [19]

Shilling

[11] Patent Number: 4,738,599

[45] Date of Patent: Apr. 19, 1988

[54] WELL PUMP

[76] Inventor: James R. Shilling, 1803 W. McCullough, Pampa, Tex. 79065

[21] Appl. No.: 879,836

[22] Filed: Jun. 27, 1986

Related U.S. Application Data

[63] Continuation-in-part of Ser. No. 694,980, Jan. 25, 1986, abandoned.

[51] Int. Cl.[4] ..... F04B 47/08

[52] U.S. Cl. ..... 417/400; 417/468

[58] Field of Search ..... 417/383, 385, 388, 390, 417/400, 460, 468, 466, 448, 449, 450; 166/237

[56] References Cited

U.S. PATENT DOCUMENTS

| | | | |
|---|---|---|---|
| 1,777,981 | 10/1930 | Mason | 417/383 |
| 2,260,127 | 10/1941 | Tebbetts, Jr. | 91/275 X |
| 2,266,094 | 12/1941 | Tebbetts, Jr. | 417/400 |
| 2,975,768 | 3/1961 | Marquis | 417/448 |
| 3,102,495 | 9/1963 | Page | 417/450 X |
| 3,282,340 | 11/1966 | Park | 417/450 X |
| 3,494,418 | 2/1970 | Young | 166/237 X |
| 3,495,659 | 2/1970 | McGill | 166/237 X |
| 4,403,919 | 9/1983 | Stanton et al. | 417/390 X |
| 4,490,095 | 12/1984 | Soderberg | 417/390 X |
| 4,595,054 | 6/1986 | Schroeder | 166/237 X |

*Primary Examiner*—Leonard E. Smith

*Attorney, Agent, or Firm*—James E. Bradley

[57] ABSTRACT

A well pump, for pumping well fluid up a tubing string, the pump having inner and outer housings, inner and outer barrels, and upper and lower valves. A hydraulic fluid line extends downward through the casing, outside of the tubing string, from the surface to the housing, below the outer barrel and outside the inner barrel, to cause the outer barrel to move up and down. A wireline tool an be used to install and to remove the inner and outer barrels from the well pump.

21 Claims, 7 Drawing Sheets

WELL PUMP

This application is a continuation-in-part of application Ser. No. 06/694,980, filed Jan. 25, 1986, now abandoned.

BACKGROUND OF THE INVENTION

1. Field of the Invention

This invention relates in general to an oil and gas well pump, and in particular to a retrievable well pump employing a reciprocating column of liquid to operate the downhole pump.

2. Description of the Prior Art

Once a hole has been drilled from the earth's surface to an oil or gas bearing formation, the oil or gas either flows to the surface naturally or it does not. Natural flow will occur only if the pressure in the reservoir is great enough to overcome the pull of gravity upon the column of fluid in the well.

If the well does not flow naturally, artificial lift must be employed to force the fluid to the surface. Various pumping systems have been applied to this task, including the popular and well known sucker rod pump. Electrical and hydraulic downhole pumps have also been used.

U.S. Pat. No. 2,266,094 (Tebbetts, Jr.), issued on Dec. 16, 1941, shows a hydraulic downhole pump, having telescoping inner and outer barrels. Hydraulic fluid is pumped down the annulus, between the tubing string and the casing, to move the outer barrel up and down. This action pumps the production fluid up the tubing string.

SUMMARY OF THE INVENTION

The well pump of the invention has inner and outer housings, inner and outer barrels, and upper and lower valves. The inner and outer barrels can be installed and removed from the housings by a wireline tool. This allows the moving parts of the well pump to be removed and refurbished, as needed, without removing the tubing string from the well.

A hydraulic fluid line extends downward from the surface to the housing of the well pump. The fluid line is located within the casing, but outside of the tubing string. Fluid in the fluid line enters the housing below the outer barrel and outside the inner barrel. The flow of hydraulic fluid through the fluid line can be reversed, to cause the outer barrel to move up and down, to pump production fluid up the tubing string.

A pressure control switch senses the pressure in the hydraulic fluid line, and reverses the flow when required. Whenever the outer barrel reaches the end of its stroke, the pressure in the hydraulic fluid line suddenly and greatly increases or decreases, and the flow is reversed.

The above, as well as additional objects, features, and advantages of the invention, will become apparent in the following detailed description.

DESCRIPTION OF THE PREFERRED EMBODIMENT

Figure 1:
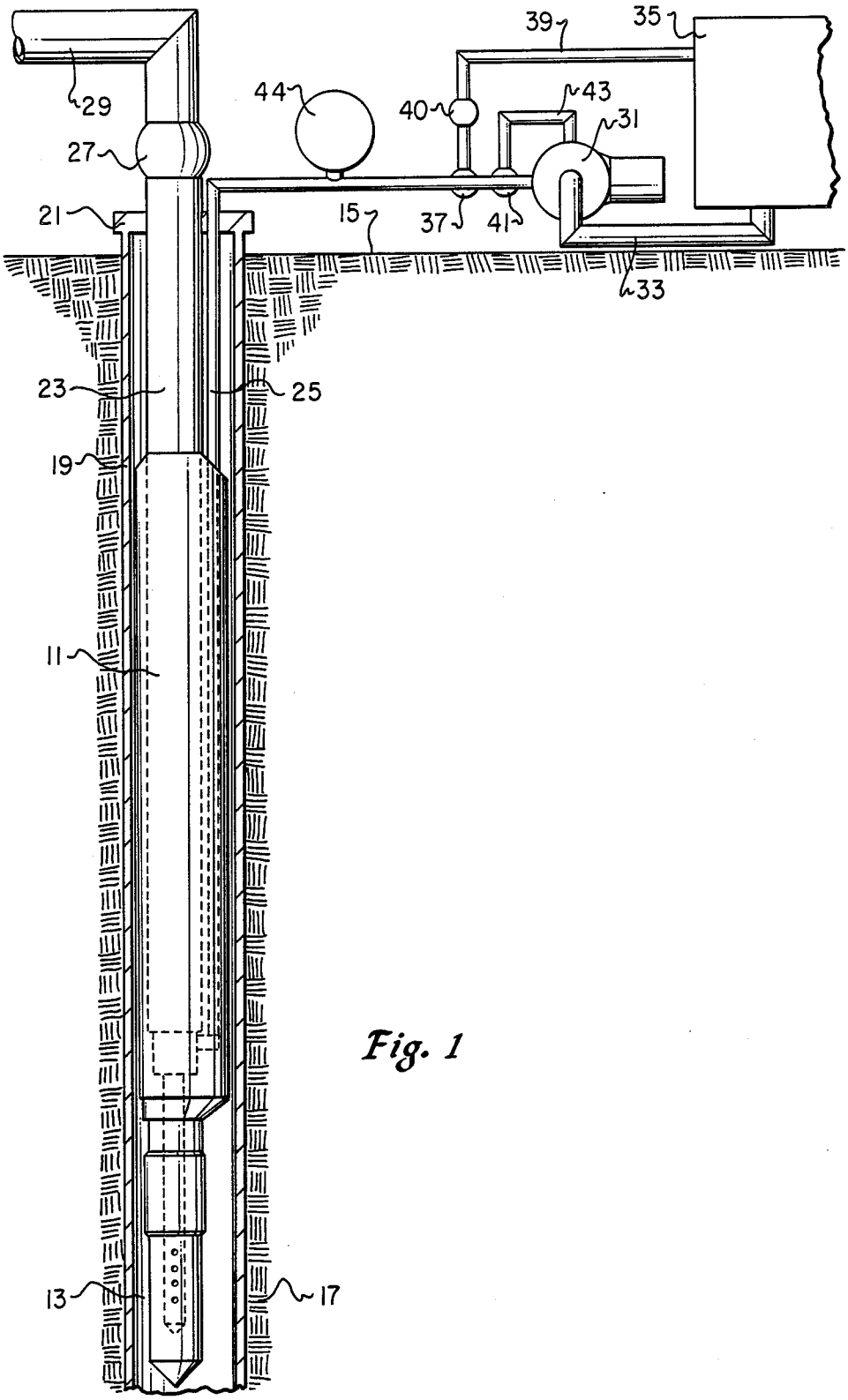
FIG. 1 is a schematic diagram of an oil or gas well installation, including the well pump of the invention.

FIG. 1 illustrates a well pump 11 installed in a well 13 which extends from the surface 15 down to an oil or gas producing formation 17. The well 13 is surrounded by well casing 19, which is capped off by a well head 21. The well pump 11 is connected to the lower end of a string of tubing 23, which extends up to the wellhead 21. A hydraulic fluid line 25 also extends from the well pump 11 up the well head 21. The well head 21 secures the tubing 23 and the hydraulic fluid line 25 in place.

The tubing string 23 continues through the well head 21, through a central valve 27, to a flow line 29. The flow line 29 carries the produced well fluid to tank batteries (not shown) for storage.

The hydraulic fluid line 25 also extends through the well head 21, and then to a hydraulic pump 31. A suction line 33 brings hydraulic fluid to the hydraulic pump 31 from a reserve tank 35. The hydraulic pump 31 is a means for supplying hydraulic fluid to the hydraulic fluid line 25.

A control valve 37 determines the direction of flow in the hydraulic fluid line 25. In one position, the control valve 37 allows hydraulic fluid to flow from the hydraulic pump 31 into the hydraulic fluid line 25. In a second position, the control valve 37 allows fluid from the hydraulic fluid line 25 to flow through the return line 39 to the reserve tank 35. A choke valve 40 regulates the flow of fluid through the return line 39, to adjust the speed of the pump stroke.

A second control valve 41 allows hydraulic fluid to flow through a free cycle line 43 whenever the hydraulic pump 31 is not needed. The control valves 37, 41 are operated by a pressure control switch 44 in response to sudden changes in the fluid pressure in the hydraulic fluid line 25.

Figure 2A:
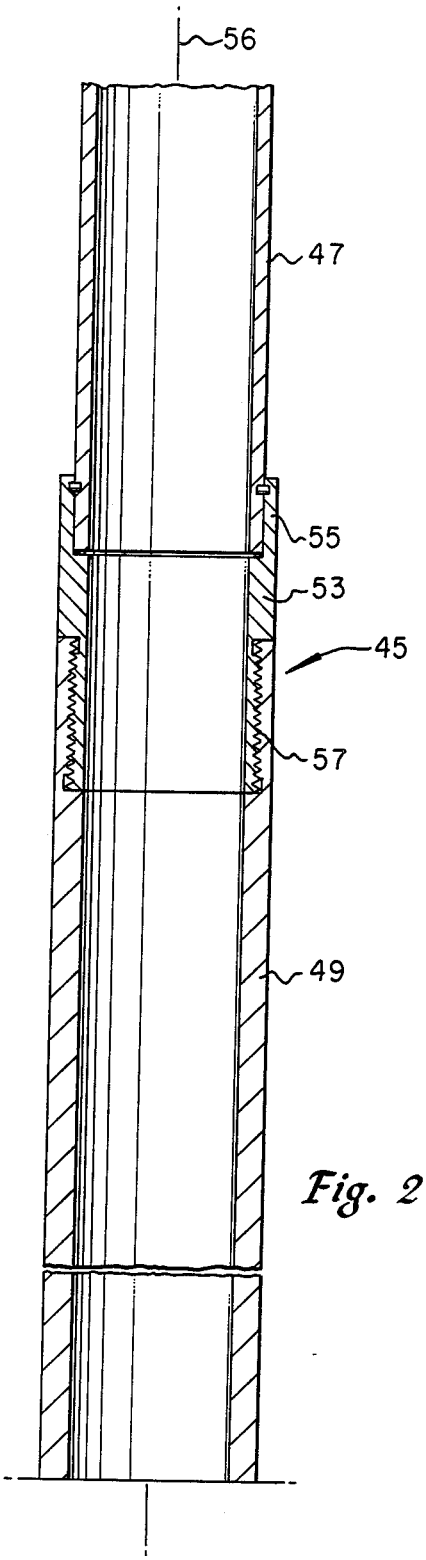
FIGS. 2A and 2B are a sectional side view of a wire line tool for use with the well pump of the invention.
Figure 2B:
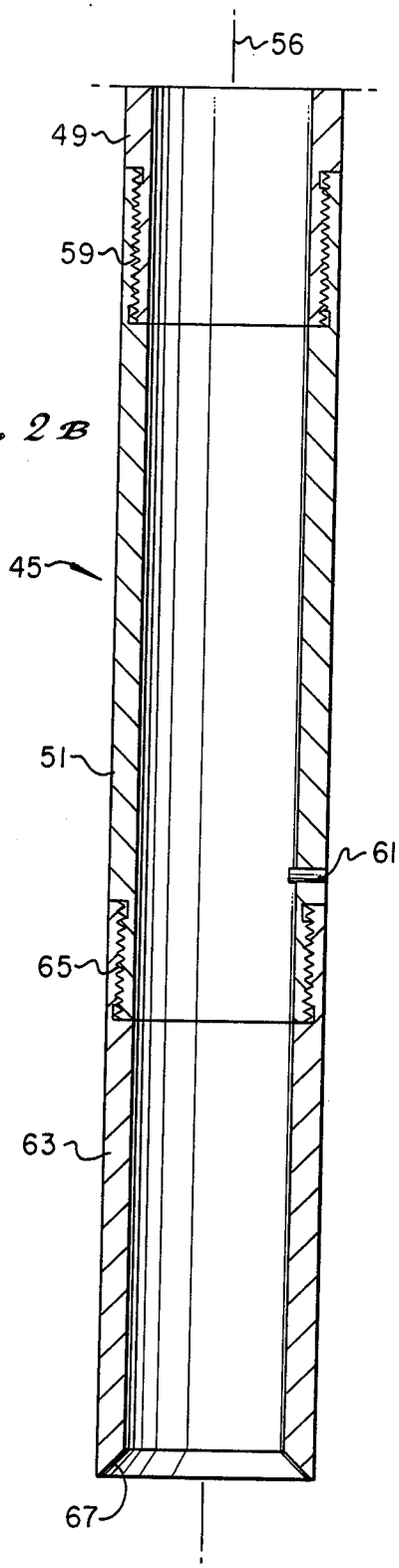

FIGS. 2A and 2B illustrate a wireline tool 45, which is suspended from an ordinary wireline (not shown). The wireline tool 45 consists of three generally cylindrical members: an upper member 47, an intermediate member 49, and a lower member 51.

The upper member 47 and the intermediate member 49 are connected together by a swivel connector 53. The upper member 47 and the connector 53 are connected together by a pin and groove connection 55. This allows the connector 53 to rotate, about the longitudinal axis 56 of the wireline tool 45, relative to the upper member 47. The connector 53 is connected to the intermediate member 49 by a threaded connection 57. The intermediate member 49 and the lower member 51 are connected together by a threaded connection 59.

A cam follower 61 is mounted on the inner surface of the lower member 51, near the lower end of the lower member 51. During retrieval operations, a lower extension 63 is connected to the lower member 51 by a threaded connection 65. The lower entension 63 has a beveled surface 67 on the lower end.

FIGS. 3A–3G show the tubing string 23 and the hydraulic fluid line 25 extending down through the well 13 to the well pump 11. The casing 19 has been omitted for clarity.

Figure 3A:
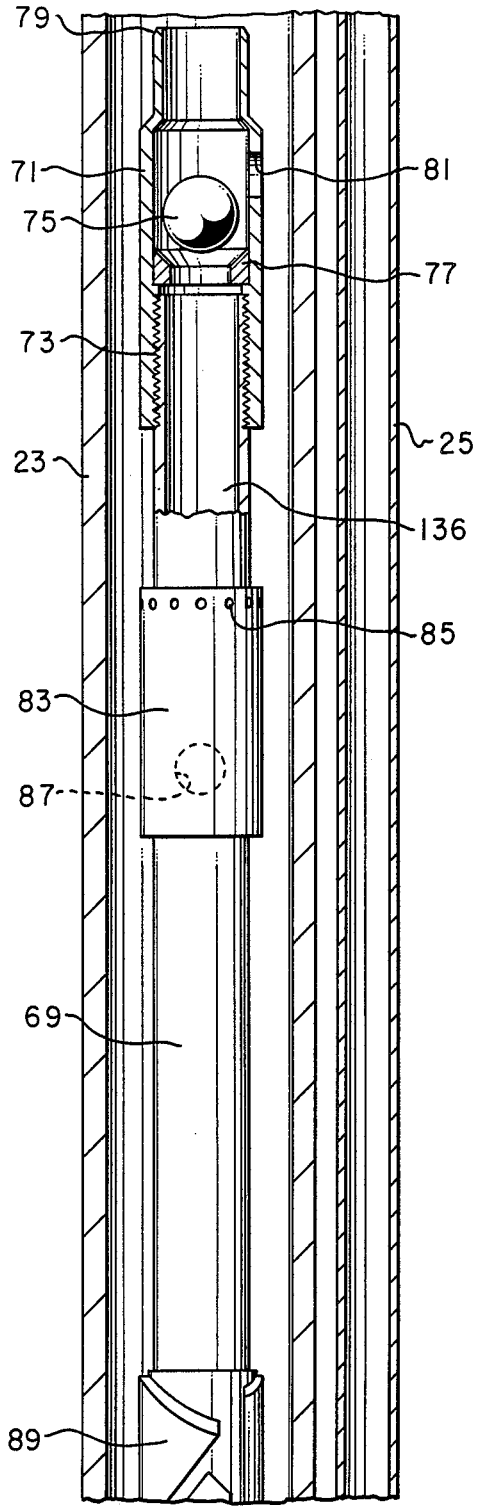
FIGS. 3A–3G are a side view, partially in section, of the preferred embodiment of the well pump of the invention.

As seen in FIG. 3A, an upper outer barrel 69 extends upward from rest of the well pump 11. An upper check valve 71, having a threaded connection 73, a ball 75, a ball seat 77, and a beveled upper surface 79, is threaded onto the upper end of the upper outer barrel 69. The check valve 71 also has a port 81, so that fluid can flow upward through the upper check valve 71. The ball 75 seats on the valve seat 77 to prevent fluid from flowing downward through the check valve 71. The check valve 71 is thus an upper valve means for allowing well fluid to flow from the outer barrel 69 into the tubing string 23 as the outer barrel 69 is lowered.

A sleeve 83 is attached to the upper outer barrel 69 with a plurality of shear pins 85. The sleeve 83 covers a relief port 87, which is shown in dotted lines. FIG. 3A also shows the upper end of a J-slot 89. The J-slot 89 is a connection means for releasably coupling the outer barrel 60 to the wireline tool 45. The inner diameter of the J-slot is slightly larger than the outer diameter of the upper outer barrel 69. This allows the upper outer barrel 69 to move vertically through the J-slot 89.

Figure 3B:
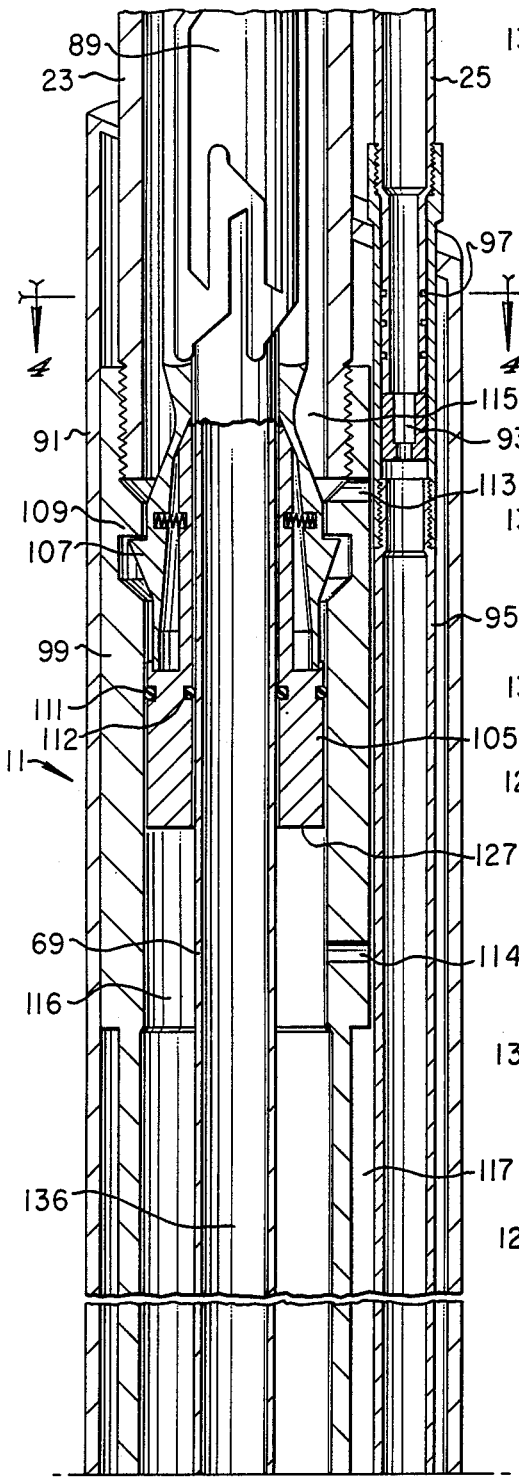

In FIG. 3B, the tubing string 23 and the hydraulic fluid line 25 are shown entering the upper end of an upper outer housing 91 of the well pump 11. The upper end of the upper outer housing 91 has a funnel shape, so that the hydraulic fluid line 25 can be stabbed into the upper outer housing 91.

Figure 4:
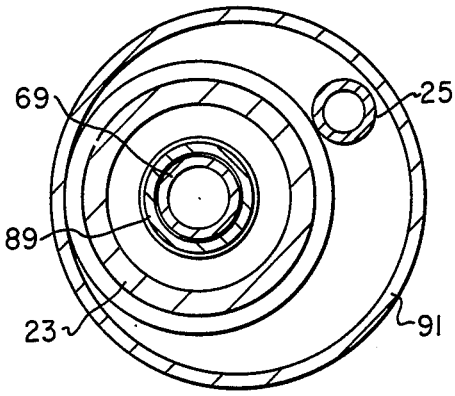
FIG. 4 is a cross sectional view of the well pump, as seen along lines 4—4 in FIG. 3B.

The fluid line 25 has a plurality of collets 93, which lock into a lower hydraulic fluid line 95. A plurality of seals 97 seal between the hydraulic fluid line 25 and the lower hydraulic fluid line 95. As shown in FIG. 4, the hydraulic fluid lines 25, 95 are offset to one side of the tubing string 23.

The well pump 11 has an upper inner housing 99, which is threaded onto the lower end of the tubing string 23. A latch mechanism 105 on the bottom of the J-slot 89 has several collets 107 which latch under a shoulder 109 on the upper inner housing 99. One O-ring seal 111 seals between the latch mechanism 105 in the upper inner housing 99, and a second O-ring seal 112 seals between the latch mechanism 105 and the upper outer barrel 69.

The upper inner housing 99 has an upper port 113, above the latch mechanism 105, and a lower port 114 below the latch mechanism 105. These ports 113, 114 allow fluid to bypass the latch mechanism 105 and flow from the interior 115 of the tubing string 23 to the interior 116 of the upper inner housing 99. Much of the sand in the fluid will filter out and be trapped in a sand trap, which is the annular area 117 between the upper inner housing 99 and the upper outer housing 91, and be kept out of the interior 116 of the upper inner housing 99.

Figure 3C:
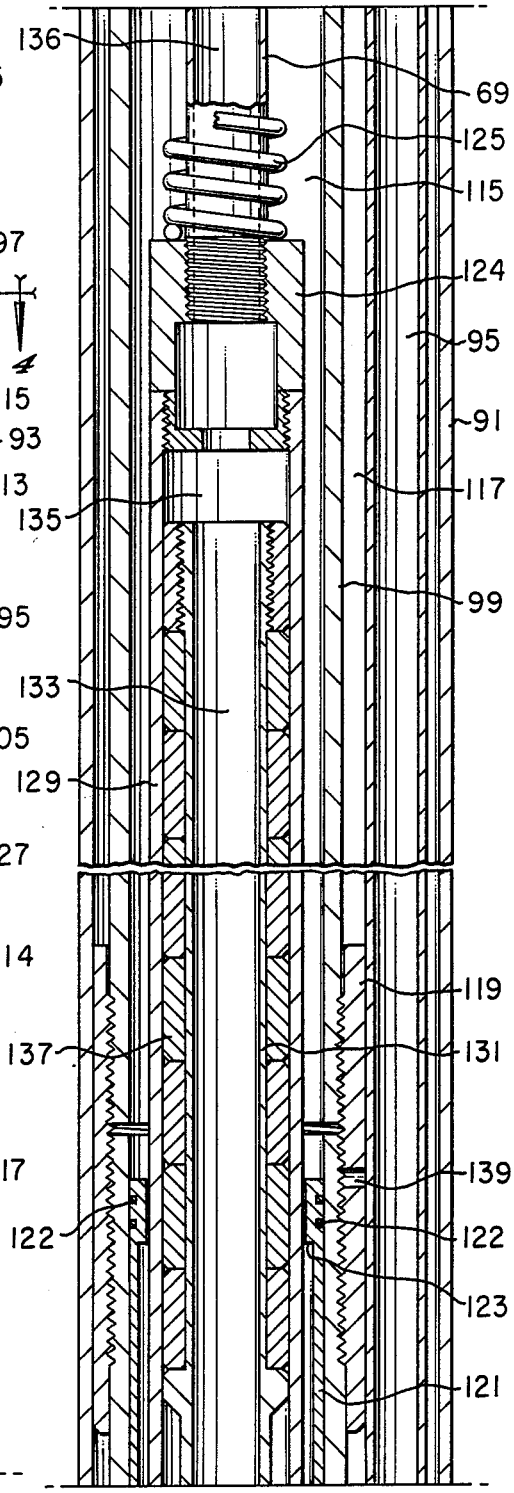

FIG. 3C illustrates the portion of the well pump 11 directly below the portion shown in FIG. 3B. The upper inner housing 99 is threaded to a coupling 119. A lower inner housing 120 in threaded into the lower end of the coupling 119.

An inner sleeve 121 is telescopically received into the coupling 119 and the lower inner housing 120. A pair of O-ring seals 122 seal between the coupling 119 and the inner sleeve 121. The inner sleeve 121 also has a downward facing shoulder 123 on the inner surface, near the upper end of the inner sleeve 121.

The upper outer barrel 69 is threaded to a spring seat 124. A coil spring 125 is mounted on top of the spring seat 124. The upper outer barrel 69 is vertically reciprocal, and is shown in its lowermost position. When the upper outer barrel 69 is in it upper position, the coil spring 125 engages the bottom surface 127 of the latch mechanism 105. A lower outer barrel 129 is threaded to lower end of the spring seat 124.

An inner barrel 131 is mounted within the lower outer barrel 129, so that the lower outer barrel 129 is concentrically located between the inner barrel 131 and the upper inner housing 99. The upper end of the inner barrel 131 is open, so that the interior 133 is in fluid contact with the interior 135 of the lower outer barrel 129 above piston rings 141. The interior 135 of the lower outer barrel 129 is in fluid communication with the interior 136 of the upper outer barrel 69.

The lower outer barrel 129 is telescopically movable relative to the inner barrel 131. A plurality of pump piston rings 137 are mounted on the outer surface of the inner barrel 131, to provide a bearing seat surface for the lower outer barrel 129 to slide against as the lower outer barrel 129 moves vertically.

A port 139 in the coupling 119 provides for fluid communication between the interior of the upper inner housing 99 and the annular area 117 between the upper inner housing 99 and the upper outer housing 91. This annular area 117 acts as a sand trap, to remove sand from fluid within the upper inner housing 99.

Figure 3D:
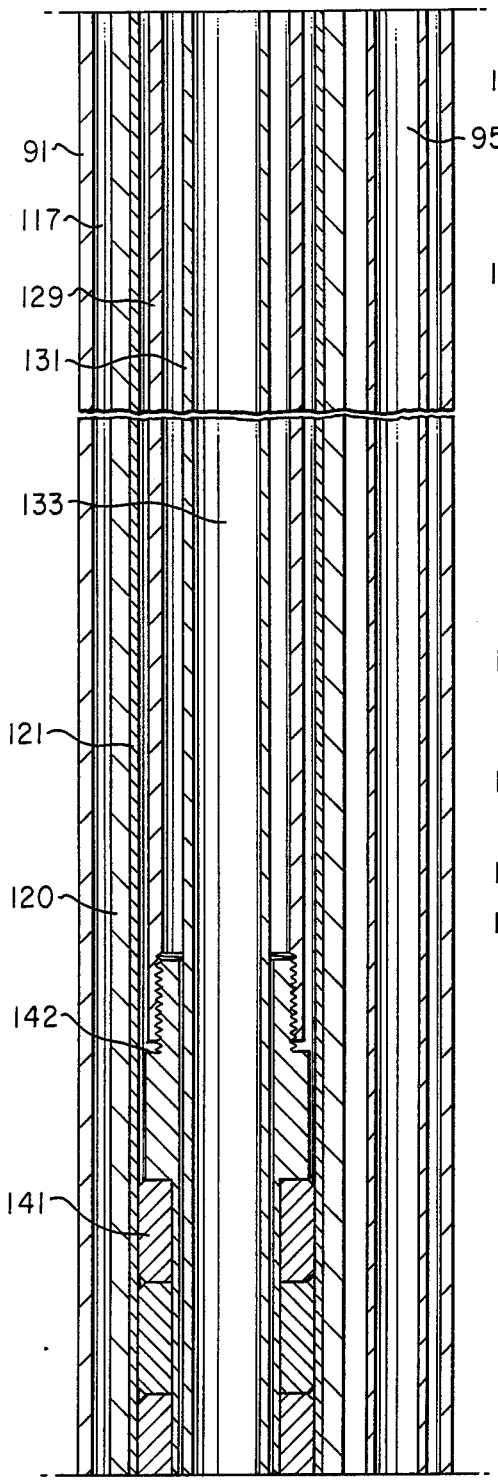

FIG. 3D is a continuation of the drawing, showing the section of the well pump 11 directly below the section shown in FIG. 3C. A plurality of pump piston rings 141 are attached to the lower end of the lower outer barrel 129, to provide a bearing surface for the lower outer barrel 129 against the inner surface of the inner sleeve 121. The uppermost pump piston ring 141 has an upwardly facing shoulder 142 for engaging the downwardly facing shoulder 123 on the inner sleeve 121.

Figure 3E:
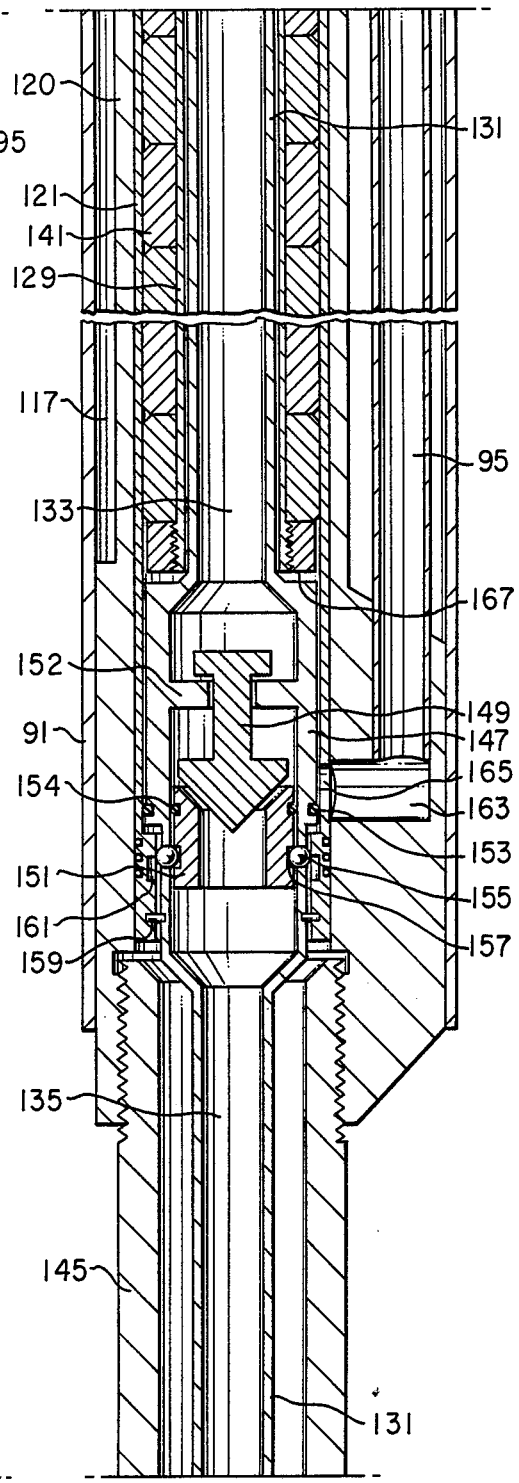

FIG. 3E is a continuation of the drawing, showing the section of the well pump 11 directly below the section shown in FIG. 3D. The lower end of the lower inner housing 120 is welded to the lower end of the upper outer housing 91. The lower end of the inner sleeve 121 is housed within the lower end of the lower inner housing 120. A plurality of seals 144 seal between the inner sleeve 121 and the lower inner housing 120. An intermediate outer housing 145 is threaded onto the lower inner housing 120.

Below the lower outer barrel 129, the inner barrel 131 has a check valve 147. This lower check valve 147 has a movable flapper 149 and a valve seat 151. The downward movement of the flapper 149 is restricted by a shoulder 152. A pari of O-ring seals 153, 154 seal between the inner sleeve 121 and the lower check valve 147 and between the lower check valve 147 and the valve seat 151.

The valve seat 151 is held in place by a plurality of steel balls 155. These steel balls 155 are located in holes in the check valve 147, and in an annular groove 157 around the valve seat 151.

A plurality of shear pins 159 hold the check valve 147 against vertical movement relative to the inner sleeve 121. The inner surface of the inner sleeve 121 also has an annular groove 161.

The lower hydraulic fluid line 95 extends downward through the connector 143, and intersects a fluid port 163 within the connector 143. From the fluid port 163, hydraulic fluid can flow through a port 165 into the inner sleeve 121. Once inside the inner sleeve 121, the hydraulic fluid exerts a pressure against the lower end 167 of the lower outer barrel 129.

Figure 3F:
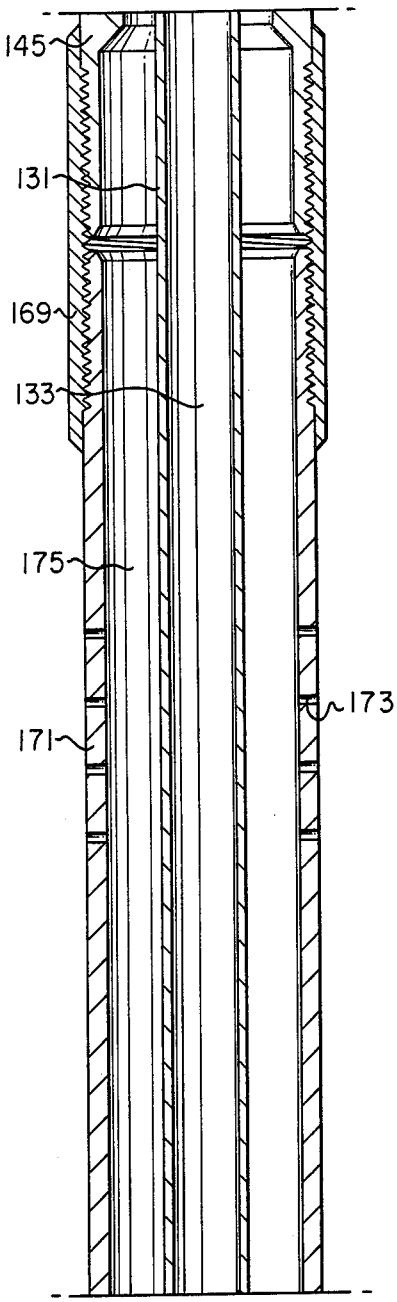
Figure 3G:
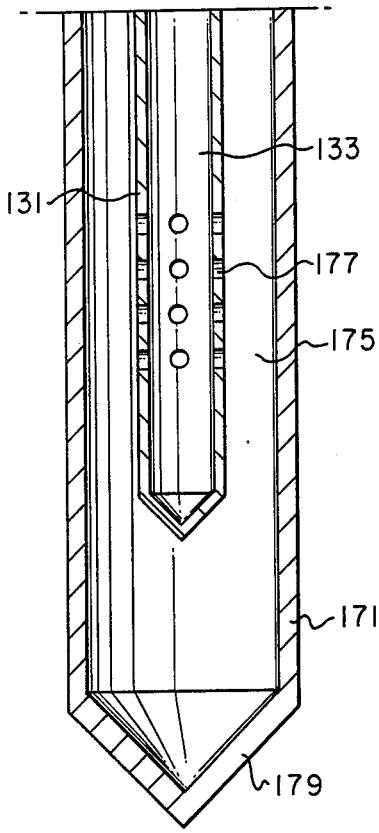

FIGS. 3F and 3G show the lowermost sections of the well pump 11. The lower end of the intermediate outer housing 145 is threaded by a connector 169 to a lower outer housing 171.

A plurality of ports 173 allow well fluid from the producing formation 17 to flow into the interior 175 of the lower outer housing 171. Ports 177 in the inner barrel 131 allow well fluid to flow from the interior 175 of the lower outer housing 171 into the interior 133 of the inner barrel 131. The lower end of the lower outer housing 171 is closed with a cap 179.

Figure 5:
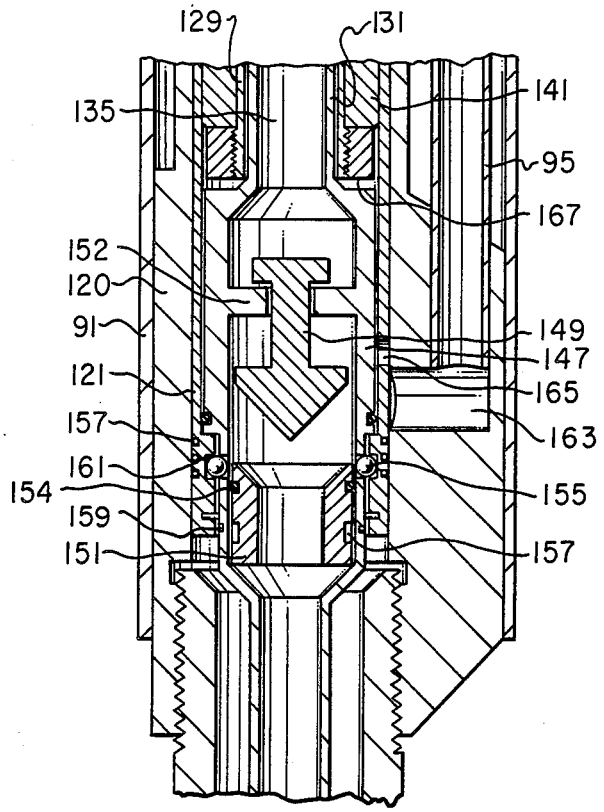
FIG. 5 is a side view of a portion of the well pump, also shown in FIG. 3E, in a released position.

FIG. 5 illustrates a second position of a portion of the well pump 11 shown in part of FIG. 3E. In this position, the inner sleeve 121 has been moved slightly upward by fluid pressure from the lower hydraulic fluid line 95. The steel balls 155 have moved outward into the annular groove 161 in the inner sleeve 121. The outward movement of the steel balls 155 has released the valve seat 151, and the valve seat 151 has fallen downward away from the flapper 149. In this position, the lower check valve 147 is in the open position, and fluid can flow through the check valve 147 in a downward direction.

The well pump 11 of the invention is installed in the following manner. The upper inner housing 99 and the outer housings 91, 145, 171 of the pump 11 are connected to the lower end of the tubing string 23, and lowered into the well 13. The hydraulic fluid line 25 is then lowered into the well 13. When the fluid line 25 reaches the upper end of the upper outer housing 91, the end of the fluid line 25 is funneled down into the proper position. The collets 93 latch into the lower hydraulic fluid line 95, and the connection is sealed by the seals 97.

The inner sleeve 121, the inner barrel 131, and the outer barrels 69, 129 are lowered into the well 13 on a wireline. A wireline tool 45, without the lower extension 63, is used. When the latch mechanism 105 reaches the well pump 11, the collets 107 latch onto the annular shoulder 109. The cam follower 61 on the wireline tool 45 follows the J-slot 89 and disconnects the wireline tool 45 from the well pump 11.

Well fluid from the producing formation 17 passes through the casing 19 to the well 13. The well fluid then flows through ports 173 into the interior 175 of the lower outer housing 171. The fluid next passes through ports 177 into the interior 133 of the inner barrel 131.

The hydraulic pump 31 pumps hydraulic fluid from the reserve tank 35 into the hydraulic fluid line 25. The hydraulic fluid flows down the hydraulic fluid line 25 and through the port 165 into the inner sleeve 121.

The pressure of the hydraulic fluid pushes up on the lower outer barrel 129, and raises the lower outer barrel 129, the upper outer barrel 69, and the upper check valve 71. As the upper outer barrel 69 rises, the interior 135 of the lower outer barrel 129 increases. The pressure inside the interior 135 of the inner barrel 131 is reduced, opening the lower check valve 147. When the lower check valve 147 opens, well fluid is drawn through the check valve 147 into the interior 133 of the inner barrel 131. The lower check valve 147 is thus a lower valve means for allowing well fluid to flow from the producing formation 17 into the inner barrel 131 when the outer barrel 129 is raised.

The hydraulic fluid continues to raise the upper and lower outer barrels 69, 129, until the coil spring 125 contacts the lower surface 127 of the latch mechanism 105. When the coil spring 125 reaches the latch mechanism 105, the fluid pressure in the hydraulic fluid line 25 suddenly and greatly increases.

The increased pressure forces an amount of hydraulic fluid to migrate into the slight clearance between the inner sleeve 121 and the pump piston rings 141 on the lower outer barrel 129. Lubricating and treating chemicals may be added to the hydraulic fluid, and inserted into the pump 11 in this manner.

The pressure control switch 44 senses the sudden increase in fluid pressure and, after a short time delay for fluid migration, switches the control valves 37, 41. This reverses the flow of the hydraulic fluid in the hydraulic fluid line 25, as the coil spring 125 and the weight of the well fluid in the well 13 push down on the outer barrels 69, 129. The outer barrels 69, 129 are pushed back down to the lower position. The pressure control switch 44 is thus a reversing means for reversing the flow of the hydraulic fluid in the hydraulic fluid line 25 to cause the outer barrels 69, 129 to move up and down relative to the inner barrel 131. The choke valve 40 controls the speed of the outer barrels 69, 129, by limiting the flow of fluid through the return line 39.

While the outer barrels 69, 129 are moving downward, the lower check valve 147 is closed, and the upper check valve 71 is open. This allows fluid from the interior 136 of the upper outer barrel 69 to flow into the tubing string 23 when the upper outer barrels 69, 129 are lowered.

Also, as the outer barrels 69, 129 move downward, the hydraulic fluid in the interior of the inner sleeve 121 is pushed out of the inner sleeve 121 and back up the hydraulic fluid line 25. The control valve 37 allows the fluid to flow from the hydraulic fluid line 25 through the return line 39 to the reserve tanks 35.

When the lower outer barrel 129 approaches the lower check valve 147, the fluid pressure in th hydraulic fluid line 25 suddenly and greatly decreases. The pressure control switch 44 senses this sudden decrease in pressure and switches the control valves 37, 41. Once again, the pump 31 forces hydraulic fluid to flow downward through the hydraulic fluid line 25 and into the inner sleeve 121. The outer barrels 69, 129 are again raised to the upper position.

As the outer barrels 69, 129 move upward, the upper check valve 71 is closed, and the lower check valve 147 is opened. Once again, fluid from the interior 175 of the lower outer housing 171 is allowed to flow into the interior 133 of the inner barrel 131. Well fluid within the interior 133 of the inner barrel 131 is forced through the lower check valve 147 into the interior 135 of the lower outer barrel 129.

The inner sleeve 121, the inner barrel 131, and the outer barrels 69, 129 can be removed from the well 13 by wireline retrieval means. First, the wireline tool 45, including the lower extension 63, is lowered into the well 13. The lower extension 63 closes the collets 107 to release the latch mechanism 105. The cam follower 61 engages the J-slot 89.

The wireline tool 45 is then raised slightly. Since the cam follower 61 is engaged by the J-slot 89, the J-slot 89 and the latch mechanism 105 are raised with the wireline tool 45. When the J-slot 89 reaches the sleeve 83, the shear pins 85 are sheared. This allows the sleeve 83 to move upward, uncovering the relief port 87. Once the relief port 87 is open, fluid can flow downward from the tubing string 23 into the interior 136 of the upper outer barrel 69.

Since the latch mechanism 105 has now been raised, the upward stroke of the outer barrels 69, 129 is not limited by the bottom 127 of the latch mechanism 105.

The outer barrels 69, 129 continue to move upward, until the shoulder 142 on the uppermost pump piston ring 141 engages the shoulder 123 on the inner sleeve 121. Continued upward movement of the outer barrels 69, 129 causes the inner sleeve 121 to be raised.

The upward movement of the inner sleeve 121 shears the shear pins 159 between the inner sleeve 121 and the inner barrel 131. When the inner sleeve 121 is in the position shown in FIG. 5, the steel balls 155 move outward into the annular groove 161 in the inner sleeve 121.

This releases the valve seat 151, and allows the valve seat 151 to fall to the bottom of the lower check valve 147. The lower check valve 147 thus remains open so that fluid can flow downward through the check valve 147. Of course, other opening means for opening the lower check valve 147 could also be used.

The steel balls 155, now lock the inner sleeve 121 and the inner barrel 131 together. The wireline tool 45 can then be removed from the well 13, taking with it the inner sleeve 121, the inner barrel 131, and the outer barrels 69, 129. The wireline tool 45 is thus a wireline retrieval means for removing the inner and outer barrels 69, 129, 131 and the upper and lower valve means 71, 147 from the housing 91, while the housing 91 remains mounted to the tubing string 23.

The well pump 11 of the invention has several advantages over the prior art. Both the inner barrel 131 and the outer barrels 69, 129 are removable from the well 13. This allows the barrels 69, 129, 131 to be serviced and replaced or returned to the pump 11. The check valves 71, 147 in the pump 11 can be opened or bypassed when the barrels 69, 129, 131 are being removed form the tubing string 23. This facilitates the flow of well fluid through the barrels 69, 129, 131 as the barrels 69, 129, 131 are being withdrawn through the tubing string 23. Further, the well pump 11 has sand traps, so that a certain amount of sand is removed from the well fluid, to reduce the abrasive effect of the well fluid on the moving parts of the pump 11.

The invention has been shown in only one of its forms. It should be apparent to those skilled in the art that it is not so limited but is susceptible to various changes and modifications without departing from the spirit thereof.

I claim:

1. A well pump, for pumping well fluid up a tubing string, located in well casing, from a producing formation to the surface, wherein the well pump comprises:

a housing, adapted to be secured to the lower end of the tubing string;

an inner barrel, releasably mounted within the housing;

an outer barrel, releasably mounted and concentrically located between the inner barrel and the housing, telescopically movable relative to the inner barrel;

lower valve means, releasably mounted with the housing, for allowing well fluid to flow from the producing formation into the inner barrel when the outer barrel is raised;

upper valve means, releasably mounted within the housing, for allowing well fluid to flow from the outer barrel into the tubing string when the outer barrel is lowered;

a hydraulic fluid line, extending downward through the casing, outside of the tubing string, from the surface to the housing, below the outer barrel and outside the inner barrel;

means for supply hydraulic fluid to the hydraulic fluid line;

reversing means for reversing the flow of the hydraulic fluid in the hydraulic fluid line to cause the outer barrel to move up and down relative to the inner barrel; and wireline retrieval means, adapted to be inserted through the tubing string, for removing the inner and outer barrels and the upper and lower valve means from the housing, while the housing remains mounted to the tubing string.

2. A well pump, as recited in claim 1, wherein the wireline retrieval means comprises:

a wireline tool, adapted to be mounted on a wireline;

connection means for releasably coupling the outer barrel to the wireline tool;

a shoulder located on the housing;

a latch mechanism, attached to the outer barrel, for latching the barrels into the housing; and a lower extension, adapted to be connected to the wireline took, for releasing the latch mechanism to enable the barrels to the removed from the housing.

3. A well pump, as recited in claim 2, wherein the connection means comprises:

a J-slot, attached to the outer barrel; and a cam follower, located in the wireline tool.

4. A well pump, as recited in claim 3, further comprising:

a coil spring, mounted around the outer barrel, to contact the latch mechanism when the outer barrel reaches the upper limit of vertical movement, and to begin the downward movement of the outer barrel.

5. A well pump, as recited in claim 4, further comprising:

a plurality of bearings, mounted on the outer surface of the inner barrel, to provide a surface for the outer barrel to slide against as the outer barrel moves vertically.

6. A well pump, for pumping well fluid up a tubing string, located in well casing, from a producing formation to the surface, wherein the well pump comprises:

an outer housing, adapted to be secured to the lower end of the tubing string;

an inner housing, releasably mounted within the outer housing;

an inner barrel, releasably mounted within the inner housing;

an outer barrel, releasably mounted and concentrically located between the inner barrel and the inner housing, telescopically movable relative to the inner barrel;

lower valve means for allowing well fluid to flow from the producing formation into the inner barrel when the outer barrel is raised;

upper valve means for allowing well fluid to flow from the outer barrel into the tubing string when the outer barrel is lowered;

a hydraulic fluid line, extending downward through the casing, outside of the tubing string, from the surface to the inner housing, below the outer barrel and outside the inner barrel;

means for supplying hydraulic fluid to the hydraulic fluid line;

reversing means for for reversing the flow of the hydraulic fluid in the hydraulic fluid line to cause the outer barrel to move up and down relative to the inner barrel;

wireline retrieval means, adapted to be inserted through the tubing string, for removing the inner housing, the inner and outer barrels, and the upper and lower valve means from the outer housing, while the outer housing remains mounted to the tubing string;

a relief port, opened by the retrieval means, for allowing fluid to flow from the tubing string into the outer barrel, while the retrieval means is removing the inner and outer barrels and the upper and lower valve means from the outer housing; and opening means for opening the lower valve means, while the retrieval means is removing the inner and outer barrels and the upper and lower valve means from the outer housing, to drain produced fluid from the tubing string.

7. A well pump, as recited in claim 6, further comprising:

a sleeve, mounted on the outer barrel for covering the relief port;

a plurality of shear pins, for releasably securing the sleeve to the outer barrel.

8. A well pump, as recited in claim 7, wherein the lower valve means comprises:

a valve body;

a flapper, mounted within the valve body;

a valve seat for sealing engagement with the flapper; and a plurality fo steel balls, for securing the valve seat within the valve body.

9. A well pump, as recited in claim 8, wherein the opening means is an annular groove on the inner housing to allow the steel balls to move radially outward out of engagement with the valve seat.

10. A well pump, for pumping well fluid up a tubing string, located in well casing, from a producing formation to the surface, wherein the well pump comprises:

an outer housing, adapted to be secured to the lower end of the tubing string;

an inner housing, releasably mounted within the outer housing;

an inner barrel, releasably mounted within the inner housing;

an outer barrel, releasably mounted and concentrically located between the inner barrel and the inner housing, telescopically movable relative to the inner barrel;

lower valve means for allowing well fluid to flow from the producing formation into the inner barrel when the outer barrel is raised;

upper valve means for allowing well fluid to flow from the outer barrel into the tubing string when the outer barrel is lowered;

a hydraulic fluid line, extending downward through the casing, outside of the tubing string, from the surface to the inner housing, below the outer barrel and outside the inner barrel;

means for supplying hydraulic fluid to the hydraulic fluid line;

reversing means for for reversing the flow of the hydraulic fluid in the hydraulic fluid line to cause the outer barrel to move up and down relative to the inner barrel;

wireline retrieval means, adapted to be inserted through the tubing string, for removing the inner housing, the inner and outer barrels, and the upper and lower valve means from the outer housing, while the outer housing remains mounted to the tubing string; and a sand trap for removing sand from the interior of the inner housing.

11. A well pump as recited in claim 10, further comprising a plurality of pump piston rings, mounted on the outer surface of the inner barrel, to provide a bearing surface for the outer barrel to slide against as the outer barrel moves vertically.

12. A well pump as recited in claim 11, further comprising a plurality of pump piston rings, mounted on the outer surface of the outer barrel, to provide a bearing surface between the outer barrel and the inner sleeve, there being a clearance between the inner sleeve and the pump piston rings on the outer barrel, so that hydraulic fluid can migrate between the inner sleeve and the outer barrel.

13. A well pump, as recited in claim 12, wherein the hydraulic fluid line is adapted to be lowered into the well casing separately from the remainder of the well pump, and releasably latched into the inner housing of the well pump.

14. A well pump, for pumping well fluid up a tubing string, located in well casing, from a producing formation to the surface, wherein the well pump comprises:

an outer housing, adapted to be secured to the lower end of the tubing string;

an inner housing, releasably mounted within the outer housing;

an inner barrel, releasably mounted within the inner housing;

an outer barrel, releasably mounted and concentrically located between the inner barrel and the inner housing, telescopically movable relative to the inner barrel;

lower valve means for allowing well fluid to flow from the producing formation into the inner barrel when the outer barrel is raised;

upper valve means for allowing well fluid to flow from the outer barrel into the tubing string when the outer barrel is lowered;

a hydraulic fluid line, extending downward through the casing, outside of the tubing string, from the surface to the inner housing, below the outer barrel and outside the inner barrel;

means for supplying hydraulic fluid to the hydraulic fluid line;

reversing means for for reversing the flow of the hydraulic fluid in the hydraulic fluid line to cause the outer barrel to move up and down relative to the inner barrel;

wireline retrieval means, adapted to be inserted through the tubing string, for removing the inner housing, the inner and outer barrels, and the upper and lower valve means from the outer housing, while the outer housing remains mounted to the tubing string;

a relief port, opened by the retrieval means, for allowing fluid to flow from the tubing string into the outer barrel, while the retrieval means is removing the inner and outer barrels and the upper and lower valve means from the outer housing;

opening means for opening the lower valve means, while the retrieval means is removing the inner and outer barrels and the upper and lower valve means from the outer housing, to drain produced fluid from the tubing string; and a sand trap for removing sand from fluid in the inner housing.

15. A method of installing a well pump in a well, comprising the steps of:

mounting a housing to the lower end of a string of tubing, and lowering the housing into the well;

lowering a hydraulic fluid line into the well beside the tubing string, and inserting the lower end of the line into a passage provided in the top of the housing;

securing a wireline tool onto the top of inner and outer barrels of a well pump, and lowering the inner and outer barrels through the tubing string and securing the inner and outer barrels into the housing; and releasing the wireline tool from the inner and outer barrels and pulling the wireline tool to the surface.

16. A method of installing a well pump in a well, as recited in claim 15, wherein the inner and outer barrels are removed from the well by the steps of:

lowering the wireline tool down the tubing string, until the wire line tool latches onto a latch mechanism on the inner and outer barrels;

raising the wireline tool to open a port in the outer housing to allow fluid to flow from the tubing string into the outer barrel;

increasing the pressure in the hydraulic fluid line to open a lower valve and to allow fluid to flow out of the inner barrel; and raising the wireline tool to remove the inner and outer barrels from the housing and the tubing string.

17. A method of installing a well pump in a well, as recited in claim 15, wherein the inner and outer barrels are removed from the well by the steps of:

lowering the wireline tool down the tubing string, until the wire line tool latches onto a latch mechanism on the well tool and closes the collets of the latch mechanism to release the latch mechanism from the housing of the well pump;

raising the wireline tool to open a port in the outer housing to allow fluid to flow from the tubing string into the outer barrel;

increasing the pressure in the hydraulic fluid line to open a lower valve and to allow fluid to flow out of the inner barrel; and raising the wireline tool to remove the inner and outer barrels from the housing and the tubing string.

18. A well pump for pumping well fluid up a tubing string, located in well casing, from a producing formation to the surface, comprising in combination:

a housing adapted to be secured to the lower end of the tubing string;

a stationary barrel and a moving barrel, each releasably mounted within the housing, the moving barrel being telescopingly recriprocable relative to the stationary barrel between a lower position and an upper position;

lower valve means, releasably mounted within the housing, for allowing well fluid to flow from the producing formation into the barrels when the moving barrel is moving to the lower position and for preventing well fluid from flowing downward out of the barrels when the moving barrel is moving to the upper position;

upper valve means, releasably mounted within the housing above the lower valve means, for allowing well fluid to flow from the barrels into the tubing string when the moving barrel is moving to the upper position and for preventing well fluid from flowing into the tubing string from the barrels when the moving barrel is moving to the lower position;

a hydraulic fluid line, extending downward through the casing outside of the tubing string, from the surface to the housing below the moving barrel;

means for supplying hydraulic fluid to the hydraulic fluid line to apply pressure to cause the moving barrel to move to the upper position;

reversing means for reversing the flow of the hydraulic fluid in the hydraulic fluid line to cause the moving barrel to move down to the lower position and back up to the upper position; and wireline retrieval means, adapted to be inserted through the tubing string, for removing the barrels and the upper and lower valve means from the housing while the housing remains mounted to the tubing string.

19. The well pump according to claim 18 further comprising:

relief port means, opened by the retrieval means, for allowing fluid to flow from the tubing string into the barrels while the retrieval means is removing the barrels and the upper and lower valve means from the housing; and opening means for opening the lower valve means to drain from the barrels produced fluid that is flowing from the tubing string into the relief port means while the retrieval means is removing the barrels and the upper and lower valve means from the housing.

20. A method of installing and operating a well pump in a well, comprising the steps of:

mounting a housing to the lower end of a string of tubing, and lowering the housing into the well;

providing a stationary barrel and a moving barrel which will telescope relative to the stationary barrel between a lower and an upper position;

providing an upper valve in the housing and a lower valve below the upper valve;

securing a wireline tool to the barrels, lowering the barrels and valves through the tubing string, and securing the barrels and valves into the housing; and releasing the wireline tool from the barrels and pulling the wireline tool to the surface; then pumping hydraulic fluid from the surface to the moving barrel to cause it to move to the upper position, drawing well fluid through the lower valve into the barrels; then reversing the flow of hydraulic fluid to cause the moving barrel to move to the lower position, with well fluid in the barrels flowing out the upper valve into the tubing string.

21. The method according to claim 20 wherein the barrels and valves are removed from the housing by the steps comprising;

lowering the wireline tool down the tubing string, until the wireline tool latches onto a latch mechanism on the barrels;

raising the wireline tool to open a port in the housing to allow fluid to flow from the tubing string into the barrels;

opening the lower valve to allow fluid flowing from the tubing string into the barrels to flow out of the barrels; and raising the wireline tool to remove the barrels and valves from the housing and the tubing string.

* * * * *